US010081417B2

(12) United States Patent
Brower

(10) Patent No.: US 10,081,417 B2
(45) Date of Patent: Sep. 25, 2018

(54) MARINE PROPULSION SYSTEM

(71) Applicant: Palmetto Propulsion, LLC, Belton, SC (US)

(72) Inventor: David R. Brower, Belton, SC (US)

(73) Assignee: Palmetto Propulsion, LLC, Belton, SC (US)

( * ) Notice: Subject to any disclaimer, the term of this patent is extended or adjusted under 35 U.S.C. 154(b) by 0 days.

(21) Appl. No.: 15/467,030

(22) Filed: Mar. 23, 2017

(65) Prior Publication Data

US 2017/0190403 A1 Jul. 6, 2017

Related U.S. Application Data

(63) Continuation-in-part of application No. 14/861,011, filed on Sep. 22, 2015, now Pat. No. 9,637,211.

(60) Provisional application No. 62/053,854, filed on Sep. 23, 2014.

(51) Int. Cl.

| | |
|---|---|
| ***B63H 20/14*** | (2006.01) |
| ***B63H 11/02*** | (2006.01) |
| ***B63B 35/73*** | (2006.01) |
| ***B63H 11/08*** | (2006.01) |

(52) U.S. Cl.

CPC ..... *B63H 11/02* (2013.01); *B63B 35/731* (2013.01); *B63H 11/08* (2013.01); *B63H 2011/087* (2013.01)

(58) Field of Classification Search

CPC ..... B63H 11/02; B63H 11/08; B63B 35/731
USPC ..... 440/38; 114/63
See application file for complete search history.

(56) References Cited

U.S. PATENT DOCUMENTS

| | | | | |
|---|---|---|---|---|
| 3,017,848 | A | 1/1962 | Bishop | |
| 3,276,415 | A | 10/1966 | Nikolaus | |
| 4,538,996 | A * | 9/1985 | Inwood | B63H 11/08 440/38 |
| 4,738,584 | A | 4/1988 | Price | |
| 5,203,728 | A * | 4/1993 | Kobayashi | B63B 17/0018 440/38 |
| 5,711,657 | A | 1/1998 | Hoffmeier | |
| 7,632,061 | B2 | 12/2009 | Neeb | |
| 2009/0163091 | A1 | 6/2009 | Shiomi | |
| 2011/0275254 | A1 | 11/2011 | Rolla | |

* cited by examiner

*Primary Examiner* — Stephen P Avila
(74) *Attorney, Agent, or Firm* — Faegre Baker Daniels LLP

(57) ABSTRACT

A marine vessel having a hull with a pair of opposite sides disposed at an angle with respect to one another, the opposite sides also disposed at an angle with respect to a water surface. A marine propulsion system is operatively coupled to the hull and includes a pair of impellers associated respectively with the pair of hull sides that rotate within respective impeller planes disposed generally parallel to the hull sides to convey water from at least one inlet though at least one outlet to provide thrust to the vessel. The marine propulsion system may also be contained within an outboard unit mounted to a transom of the vessel.

23 Claims, 17 Drawing Sheets

MARINE PROPULSION SYSTEM

CROSS REFERENCE TO RELATED APPLICATIONS

This application is a continuation-in-part of U.S. patent application Ser. No. 14/861,011, entitled PROPULSION SYSTEM HAVING COUNTER-ROTATING IMPELLERS, filed on Sep. 22, 2015, which claims priority to U.S. Provisional Patent Application Ser. No. 62/053,854, entitled PROPULSION SYSTEM HAVING COUNTER-ROTATING IMPELLERS, filed on Sep. 23, 2014, and the entire disclosures of each are hereby expressly incorporated herein by reference.

FIELD OF THE DISCLOSURE

The present disclosure relates to marine propulsion systems and, more specifically, to a "final drive" arrangement having counter-rotating impellers, that can be coupled to many types of existing propulsion arrangements, including outboards, sterndrives, pod drives, inboards and/or the like.

BACKGROUND

Existing marine propulsion systems typically utilize propellers (e.g., in the case of outboards, inboards, sterndrives, and pod drives) or impellers (e.g., in the case of jet drives) which rotate in a direction generally perpendicular to the surface of the water (or keel of the vessel). In other words, the rotation axes of known propellers or impellers extend along a direction generally parallel to the surface of the water. These systems may have certain drawbacks, including high drag levels due to excessive equipment surface below the waterline, high levels of cavitation due to the inefficiency of the direction of rotation in comparison to the direction of water flow, safety related issues due to rotating blades exposed in open water, and/or the like.

Many conventional marine propulsion systems also include a direct connection between the engine or motor and the drive unit, thereby locking the propeller speed directly in relation to the input speed. This reduces the efficiency of the system under certain conditions.

SUMMARY

The present disclosure provides a marine vessel having a hull with a pair of opposite sides disposed at an angle with respect to one another, the opposite sides also disposed at an angle with respect to a water surface. A marine propulsion system is operatively coupled to the hull and includes a pair of impellers associated respectively with the pair of hull sides that rotate within respective impeller planes disposed generally parallel to the hull sides to convey water from at least one inlet though at least one outlet to provide thrust to the vessel. The marine propulsion system may also be contained within an outboard unit mounted to a transom of the vessel.

Embodiments of the present disclosure include a marine propulsion system that is adaptable to many existing powerplant designs, facilitates increased safety as a result of no exposed moving blades, facilitates improved propulsion efficiency through lower case drag and improved water flow arrangement through the propulsor, facilitates the ability to change the ratio of input speed to impeller speed, and facilitates improved vessel control as a result of control surfaces and outlet nozzle configurations.

Embodiments include a marine propulsion system having an input shaft attached directly to an outboard, sterndrive, pod drive or inboard/transfer case output shaft. In embodiments, the propulsion system is configured to replace the lower unit, or drive case, on existing outboards, sterndrives, and pod drives, and may be directly mounted to an inboard vessel when driven by a 90 degree drive case connected to the inboard engine/transmission. The input shaft may be directly connected to an idler or drive gear, which is used to drive a first impeller gear. The first impeller gear drives a second impeller gear, thereby connecting the impellers in a counter-rotation configuration. The input gears may be designed such that the impeller rotation of the impellers draws water through the impellers and towards the aft (rear) portion of the vessel and into an output nozzle. In embodiments, the input shaft may be directly connected to a transmission device, such as a hydro-mechanical transmission or a constant velocity transmission, which is connected to one of the impeller gears.

Because the impellers may be constantly in motion as long as the engine or motor are operating, water pressure is available near the impeller output area which can be utilized to cool the engine in the case of an internal combustion engine. This may eliminate a need for external water pumps which may be prone to premature wear and failure. Additionally, the impellers may be arranged in parallel with the water surface, thereby mitigating drag on the propulsion system housing. The housing may be designed such that it provides lift to the vessel as well as control surfaces which assist in steering and boat trim.

A marine propulsion system includes two counter-rotating impellers arranged in a fashion generally parallel to the surface of the water and driven by two counter-rotating drive gears which are attached to a drive shaft through means of either a drive gear directly attached to the input drive shaft from the engine or through a transmission device which may change the drive ratio between the engine and the propulsion system gears. A housing designed to envelop the impellers, may provide water ingress and egress paths, including inlet ports which prevent accidental access to the impeller region, and a movable output nozzle on the outlet of the housing which provides steering control, trim control, and thrust reversal. The housing may also provide a path for exhaust gas flow from an engine under the water level, provide a water flow path for cooling water that is transferred from the impellers to the engine, and/or provide a hydro-dynamic surface and control surface to assist with the control of the vessel. In embodiments, the propulsion system is highly adaptable and may be utilized in conjunction with outboard, sterndrive, and/or pod drive propulsion arrangements, or may be integrated directly into the hull of the vessel and driven similar to an inboard propulsion arrangement, e.g., by using a 90 degree drive gear housing inside the vessel.

In one form thereof, the present disclosure provides a marine vessel, including a hull having a pair of opposite sides disposed at an angle with respect to one another and with respect to a water surface; and a marine propulsion system operatively coupled to the hull and including a pair of impellers respectively associated with the pair of hull sides that rotate within respective impeller planes disposed generally parallel to the hull sides to convey water from at least one inlet through at least one outlet to provide thrust to the vessel; and at least one drive source drivingly coupled to the impellers.

In another form thereof, the present disclosure provides a marine vessel, including a hull having a transom and a pair of sides disposed at an angle with respect to one another and with respect to a water surface; and at least one outboard unit attached to the transom and including a marine propulsion system including at least one drive source; a housing including at least one inlet and at least one outlet; and an impeller disposed within the housing that rotates within an impeller plane disposed generally parallel to one of the sides of the hull and at an angle with respect to a water surface to convey water from the inlet though the outlet to provide thrust to the vessel.

Figure 1:
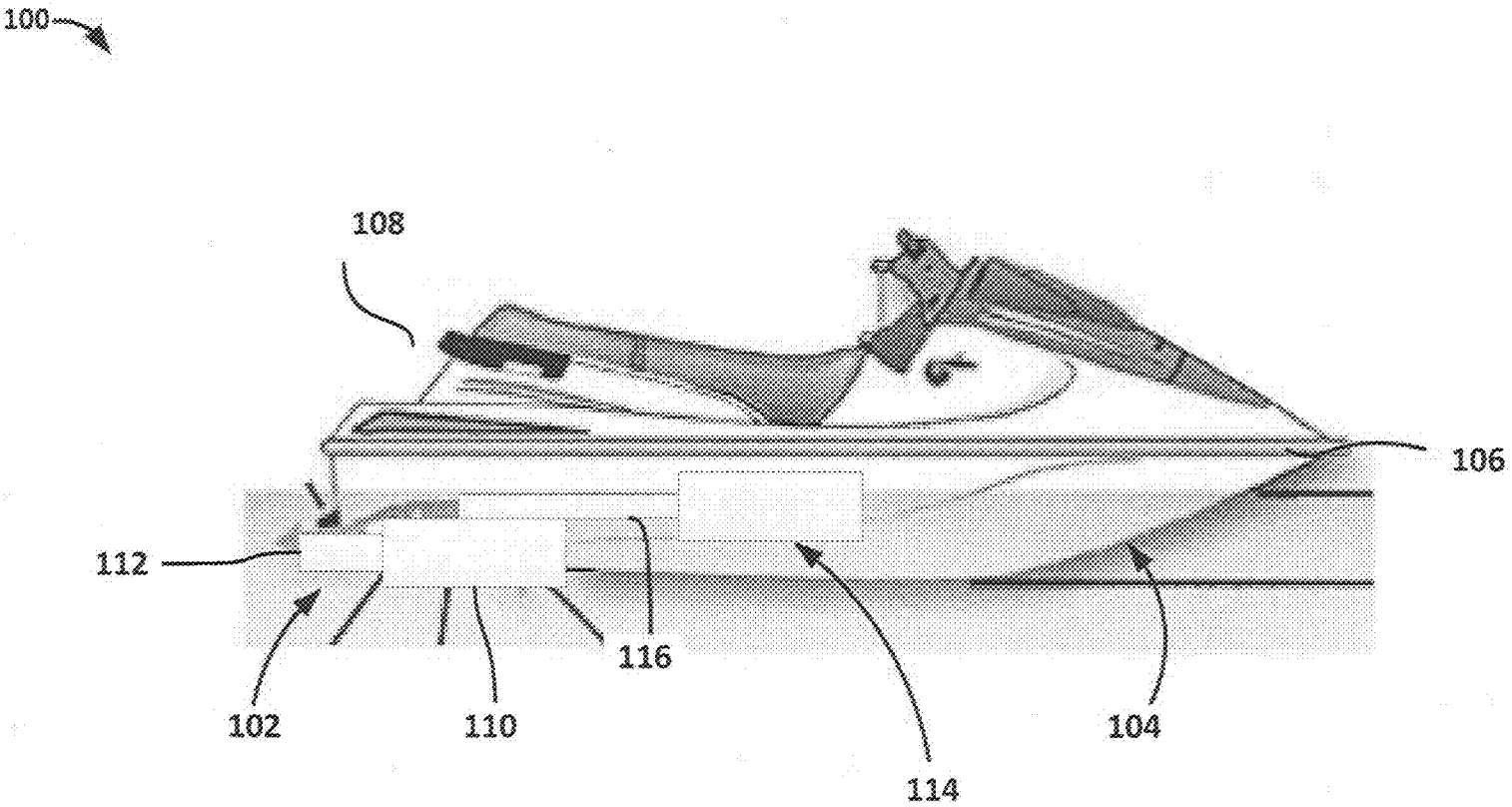
FIG. 1 is a schematic diagram depicting a marine vessel with a marine propulsion system in accordance with embodiments of the disclosure.

While the present disclosure is amenable to various modifications and alternative forms, specific embodiments have been shown by way of example in the drawings and are described in detail below. The present disclosure, however, is not limited to the particular embodiments described. On the contrary, the present disclosure is intended to cover all modifications, equivalents, and alternatives falling within the ambit of the present disclosure as defined by the appended claims.

DETAILED DESCRIPTION

FIG. 1 a schematic diagram depicting a marine vessel 100 with a marine propulsion system 102 in accordance with embodiments of the disclosure. The vessel 100 may include any type of vehicle configured for traveling on and/or in a body of water. For example, the vessel 100 may be a personal watercraft, a fishing boat, a freighter, a passenger ship, a tug boat, a submarine, and/or the like. As shown in FIG. 1, the vessel 100 includes a hull 104 having a bow 106 and a stern 108. The marine propulsion system 102 may be coupled to and/or disposed within (or partially within) the hull 104 at or near the bow 106 or the stern 108. In embodiments, the vessel 100 may include more than one marine propulsion system 102. For example, the vessel 100 may include a first marine propulsion system 102 at or near the bow 106 and a second marine propulsion system 102 at or near the stern 108. In this manner, multiple marine propulsion systems 102 may facilitate greater control over the direction of travel of the vessel 100.

As shown in FIG. 1, the marine propulsion system 102 may include a housing 110 and an output nozzle 112. In embodiments, the housing 110 may be configured to be coupled to the vessel 100 such as, for example, by being coupled to the hull 104, disposed at least partially within the hull 104, and/or the like. The housing 110 may be removably coupled to the hull 104, fixedly coupled to the hull 104, and/or coupled to the hull 104 in such a manner as to enable the housing 104 to move (e.g., rotate, pivot, etc.) in response to actuation by a control mechanism. The output nozzle 112 may be moveable so as to facilitate steering the vessel 100. The propulsion system 102 may be powered by a prime mover such as engine 114 or an electric motor, for example, which is connected to the propulsion system 102 by a transmission 116. The transmission 116 may be any type of transmission such as, for example, a standard gear train, a belt drive, a continuous variable transmission (CVT), and/or the like.

According to embodiments, the marine propulsion system 102 includes two counter-rotating impellers arranged in a fashion generally parallel to the surface of the water. In other words, the rotation axes of the impellers extend in directions substantially perpendicular to the surface of the water. The propulsion system 102 may be configured to be highly adaptable and may be utilized in conjunction with outboard, sterndrive, and/or pod drive propulsion arrangements and/or may be integrated directly into the hull 104 of the vessel 100 and driven similar to an inboard propulsion arrangement, for example, by using a 90 degree drive gear housing inside the vessel 100. The housing 110, which may be designed to surround or envelop the impellers, provides water ingress and egress paths. The output nozzle 112 may be moveable, thereby facilitating both steering and trim control. Additionally, the output nozzle 112 may provide a path for exhaust gas flow from an engine under the water level, provide a water flow path for cooling water that is transferred from the impellers to the engine, and/or provide a hydro-dynamic surface and control surfaces to assist the planning and control of the vessel.

FIGS. 2-7 depict an illustrative marine propulsion system 200 in accordance with embodiments of the disclosure. For example, the marine propulsion system 200 may be, or include, the marine propulsion system 102 depicted in FIG. 1 and may be configured to be coupled to a vessel (e.g., the vessel 100 depicted in FIG. 1). As shown in FIGS. 2-7, the marine propulsion system 200 includes a housing 202 and an output nozzle 204 coupled to a rear portion 206 of the housing 202. The output nozzle 204 may be moveably (e.g., pivotably) coupled to the housing 202. In this manner, the output nozzle 204 may be used for steering and/or other positional control of a vessel to which it is attached. One or more winglets or other features (not shown) may be disposed on the outside of the output nozzle 204 to further achieve hydrodynamic objectives.

The housing 202 may enclose a chamber 205, and generally includes an upper surface 208, a generally parallel and opposite-facing lower surface 210, a front portion 212, and the rear portion 206. The upper surface 208 may include attachment features (not shown) for coupling the housing 202 to a hull of a vessel, and such, attachment features may be included on other portions of the housing 202 such as, for example, for coupling the housing 202 within a portion of a hull. Control surfaces may be disposed on the outside of other portions of the housing 202. In embodiments, for example, one or more winglets may be disposed on each side of the housing 202 at the front portion 212 and/or the rear portion 206. These control surfaces may facilitate improved steering under off-throttle conditions.

Figure 2:
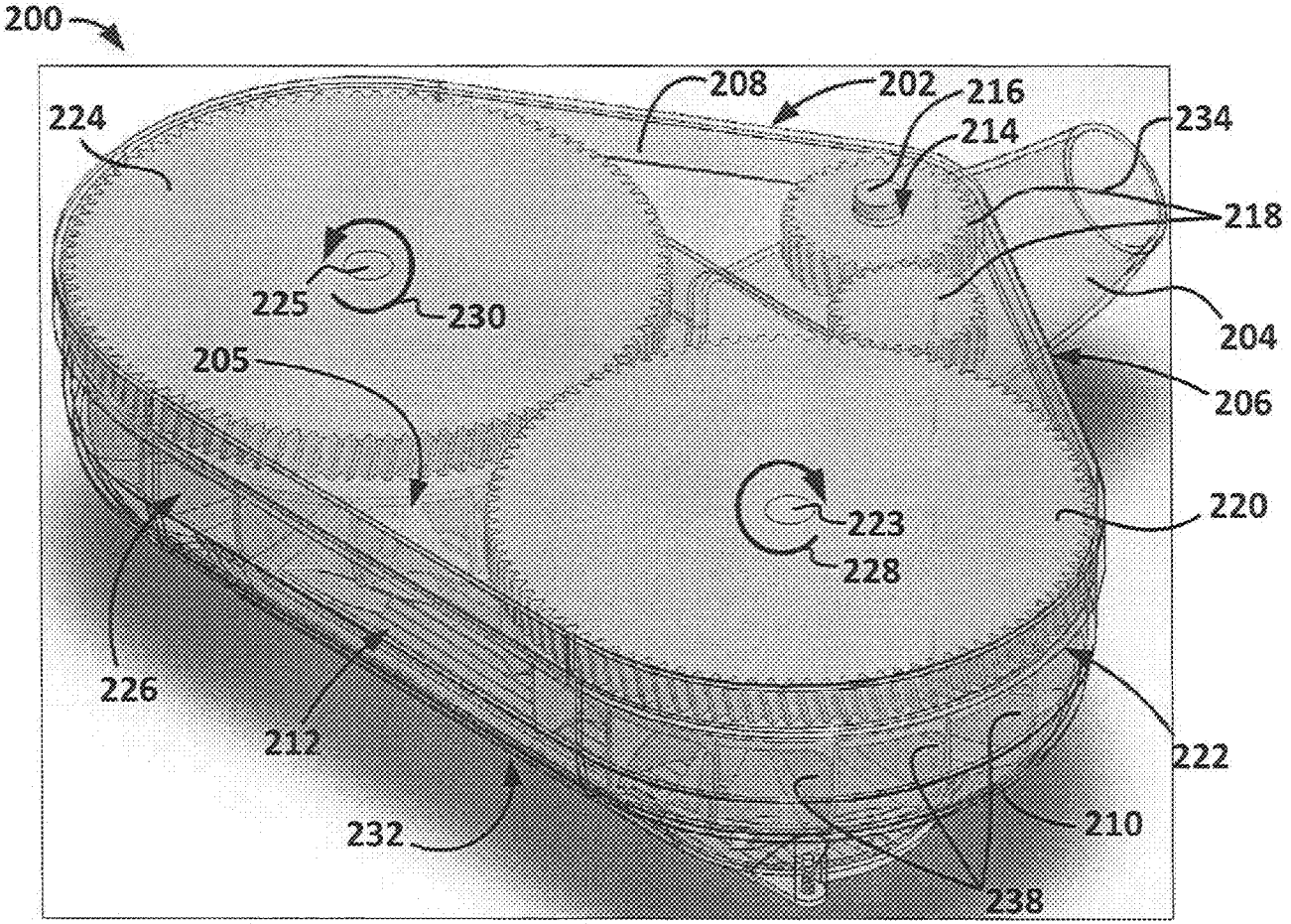
FIG. 2 is a partially-transparent upper perspective view of a marine propulsion system in accordance with an exemplary first embodiment of the present disclosure.
Figure 4:
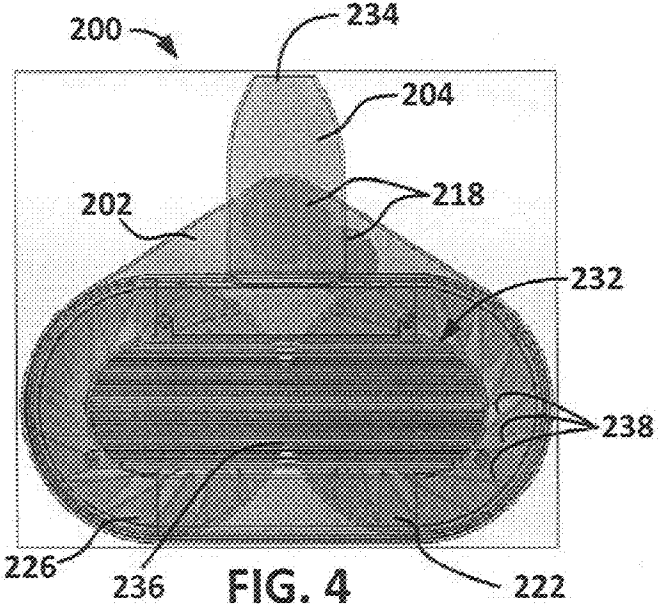
FIG. 4 is a partially-transparent bottom view of the marine propulsion system depicted in FIGS. 2 and 3.
Figure 3:
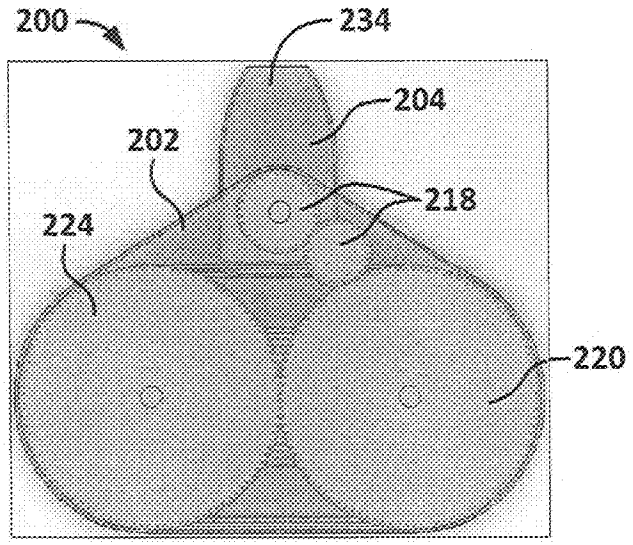
FIG. 3 is a partially-transparent top view of the marine propulsion system depicted in FIG. 2.
Figure 5:
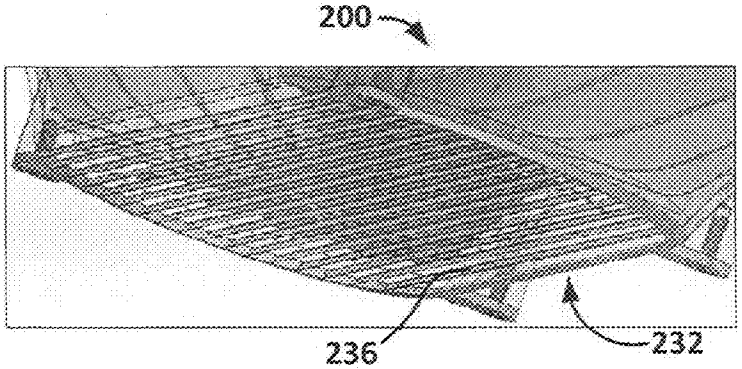
FIG. 5 is a lower perspective view of a portion of the marine propulsion system depicted in FIGS. 2-4.
Figure 6:
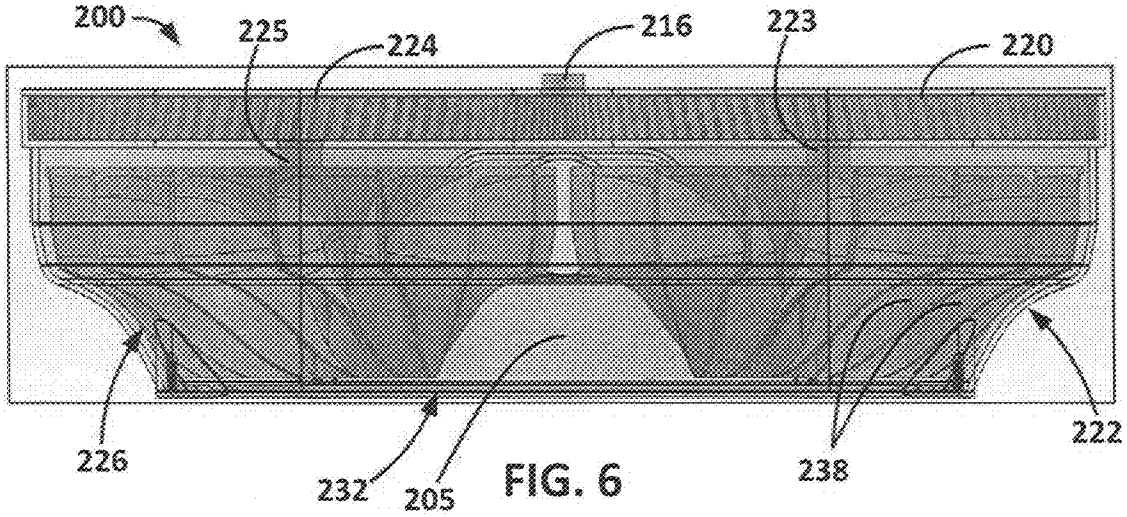
FIG. 6 is a partially-transparent front view of the marine propulsion system depicted in FIGS. 2-5.

As shown in FIG. 2, the upper surface 208 of the housing 202 may include an aperture 214 through which a drive shaft 216 may pass. As shown in FIG. 2, the transmission interface mechanism 216 may be coupled to one or more drive gears 218, which may engage a first impeller gear 220 that is coupled to a first impeller 222 via a gear shaft 223. The first impeller gear 220 may also be configured to engage a second impeller gear 224 that is coupled to a second impeller 226 via a gear shaft 225. In this manner, the first impeller 222 may be configured to rotate in a clockwise direction 228, which causes the second impeller 226 to rotate in a counterclockwise direction 230. The counter-rotating impellers 222 and 224 pull water in through an input port 232 disposed in the lower surface 210 of the housing 202 and push water out of the nozzle 204, through an opening 234 disposed therein. A grate 236 (or other protective covering such as, for example, a screen) may be disposed over the input port 232 to prevent objects from entering the chamber 205 and causing damage to, and/or being damaged by, the impellers 222 and 226 and/or other parts within the housing 202.

In embodiments, the housing 202 may include two input ports 232 such that a first input port 232 is arranged to provide water input to a first impeller 222 and a second input port 232 is arranged to provide water input to a second impeller 226. Any number of desired input ports may be disposed within the housing at any number of different positions. Additionally, the input port 232 may be configured according to any number of different shapes and may, in embodiments, be configured so as to increase the flow of water, decrease the flow of water, focus the flow of water, and/or the like. In embodiments, the input port 232 may include an adjustable feature configured to enable a user and/or control system to adjust the profile of the input port 232.

Figure 7:
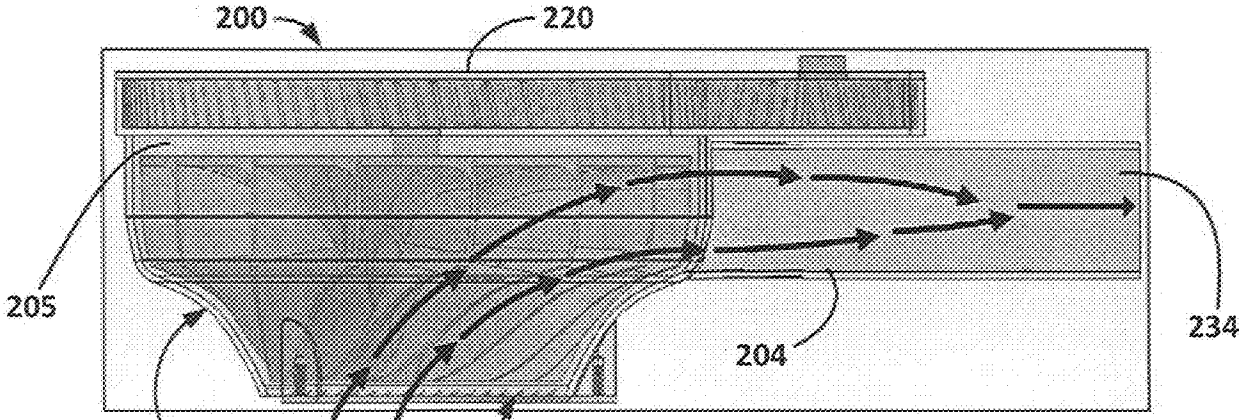
FIG. 7 is a partially-transparent side view of the marine propulsion system depicted in FIGS. 2-6.

Each of the impellers 222 and 226 may include a number of blades 238 configured such that as the impeller rotates, water is moved from the input port 232 toward the output nozzle 204, e.g., along an illustrative flow path generally indicated at 240, shown in FIG. 7. The impellers 222 and 226 (and blades 238) may be configured according to any number of centrifugal impeller designs. Additionally, in embodiments, the blades 238 may be configured to optimize propulsion in view of various factors such as, for example, vessel weight, vessel configuration, water depth, average water temperatures, cavitation thresholds, and/or the like.

FIGS. 8-13 depict another illustrative marine propulsion system 300 in accordance with embodiments of the disclosure. The marine propulsion system 300 includes generally similar features and components as those in the marine propulsion system 200 depicted in FIGS. 2-7, with the exception of the design of the impellers 302 and 304 and the location of the input port 306. As shown in FIGS. 8-13, the impellers 302 and 304 may be designed to be similar to Pelton wheels, having a shorter profile and blades 308 designed for pushing water in a more linear direction 310, from the front 312 of the system 300 to the rear 314 of the system 300.

For example, the marine propulsion system 300 may be, or include, the marine propulsion system 102 depicted in FIG. 1 and may be configured to be coupled to a vessel (e.g., the vessel 100 depicted in FIG. 1). As shown in FIGS. 8-13, the marine propulsion system 300 includes a housing 316 and an output nozzle 318 coupled to the rear portion 314 of the housing 316. The output nozzle 318 may be moveably (e.g., pivotably) coupled to the housing 316. In this manner, the output nozzle 318 may be used for steering and/or other positional control of a vessel to which it is attached. One or more winglets or other features may be disposed on the outside of the output nozzle 318 to further achieve hydrodynamic objectives.

Figure 8:
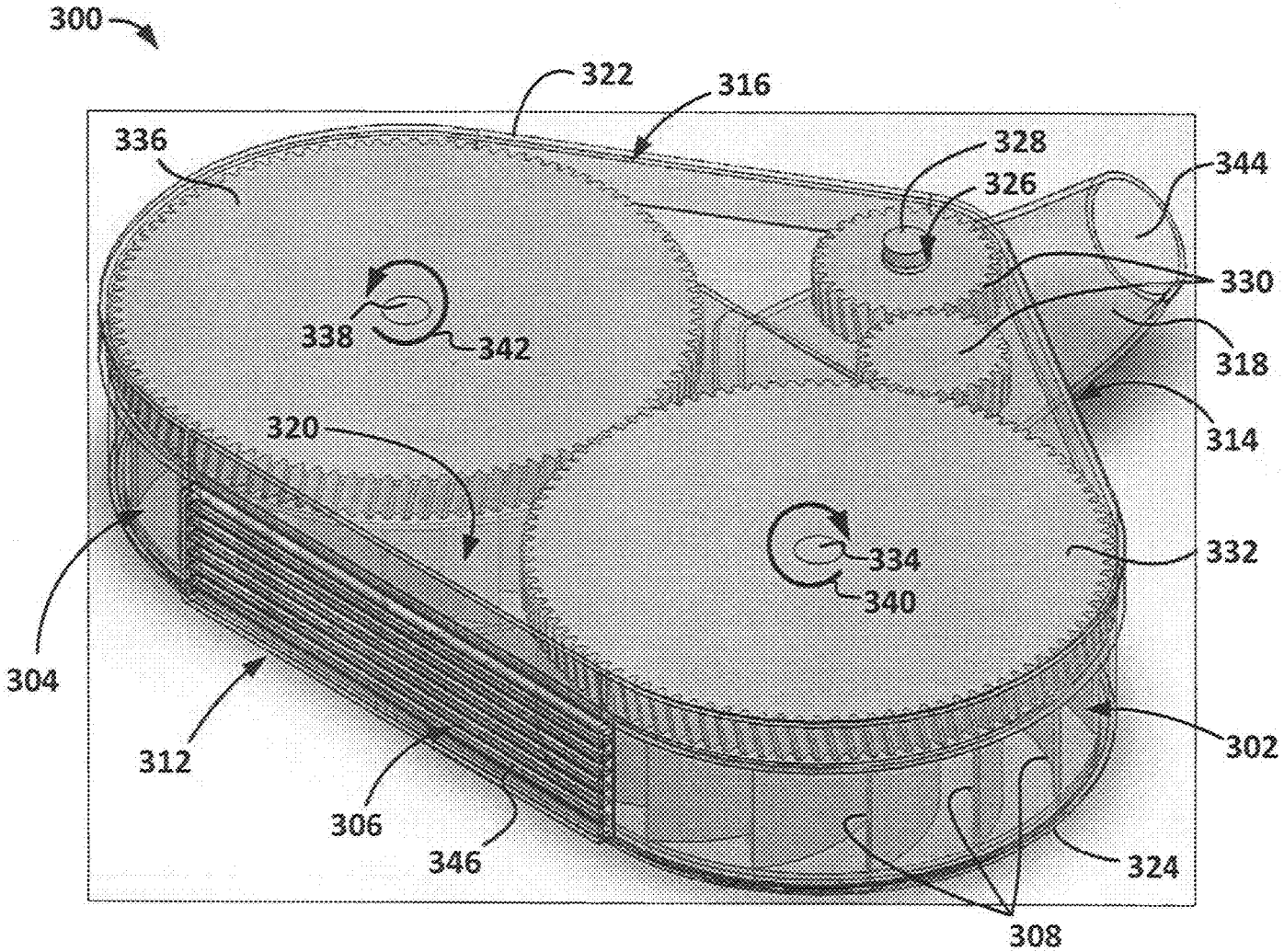
FIG. 8 is a partially-transparent upper perspective view of another marine propulsion system in accordance with an exemplary second embodiment of the present disclosure.
Figure 10:
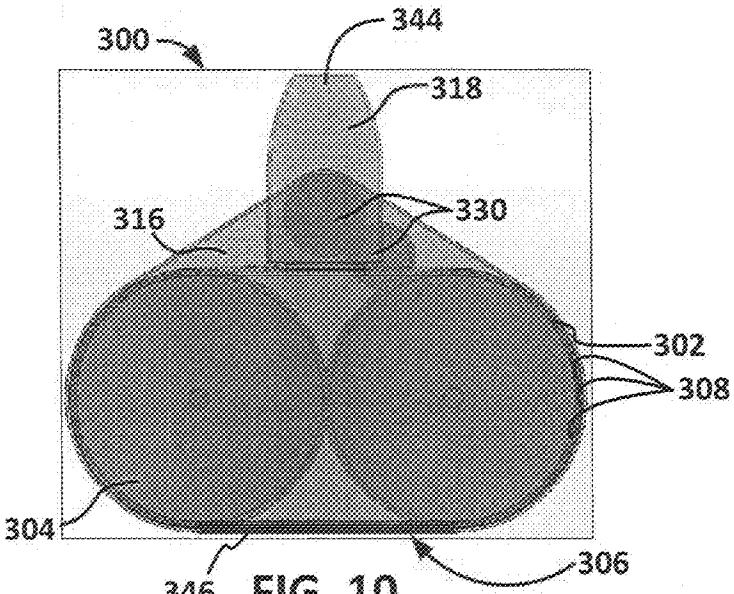
FIG. 10 is a partially-transparent bottom view of the marine propulsion system depicted in FIGS. 8 and 9.
Figure 9:
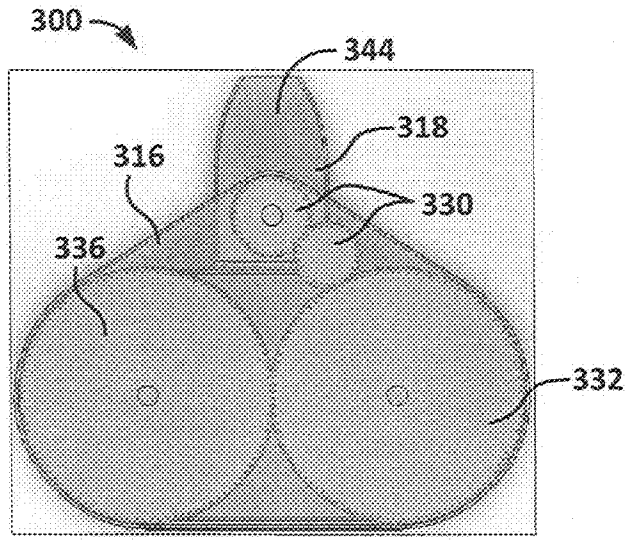
FIG. 9 is a partially-transparent top view of the marine propulsion system depicted in FIG. 8.
Figure 11:
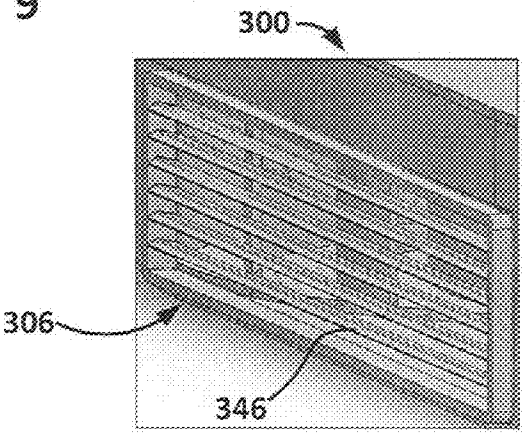
FIG. 11 is a front perspective view of a portion of the marine propulsion system depicted in FIGS. 8-10.
Figure 12:
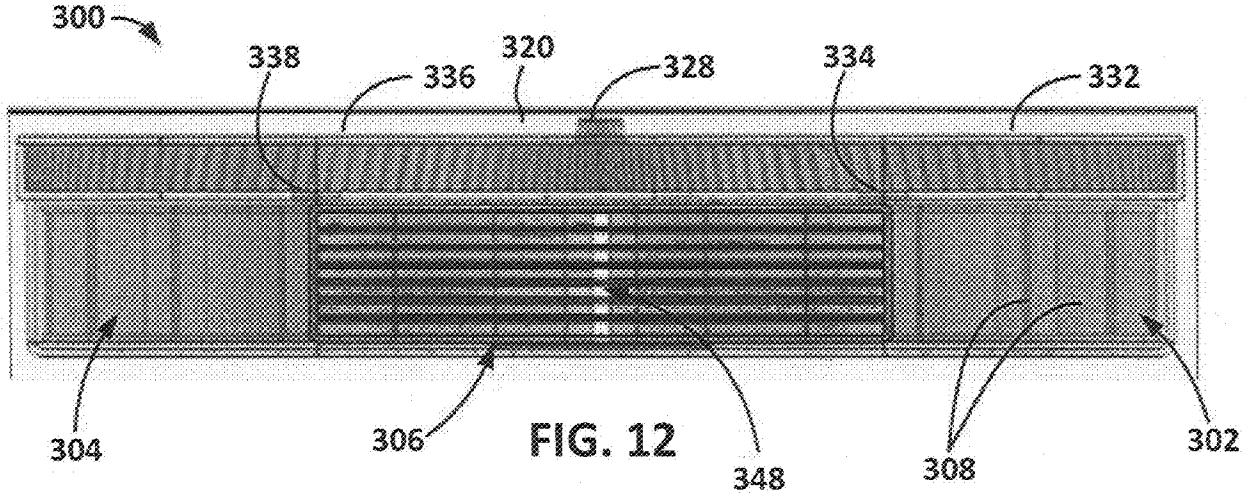
FIG. 12 is a partially-transparent front view of the marine propulsion system depicted in FIGS. 8-11 in accordance with embodiments of the present disclosure.
Figure 13:
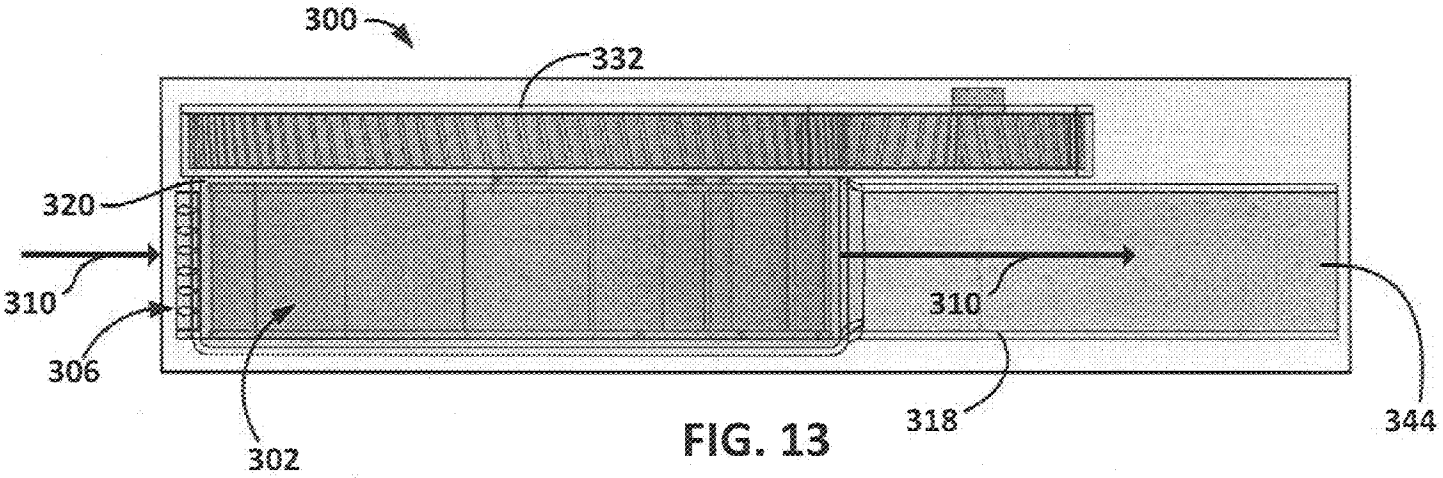
FIG. 13 is a partially-transparent side view of the marine propulsion system depicted in FIGS. 8-12.

The housing 316 may enclose a chamber 320, and generally includes an upper surface 322, a generally parallel and opposite-facing lower surface 324, the front portion 312, and the rear portion 314. The upper surface 322 may include attachment features (not shown) for coupling the housing 316 to a hull of a vessel. In embodiments, attachment features may be included on other portions of the housing 316 such as, for example, for coupling the housing 316 within a portion of a hull. As shown in FIG. 8, the upper surface 322 of the housing 316 may include an aperture 326 through which a drive shaft 328 may pass. As shown in FIG. 8, the drive shaft 328 may be coupled to one or more drive gears 330, which may engage a first impeller gear 332 that is coupled to the first impeller 302 via a gear shaft 334. The first impeller gear 332 may also be configured to engage a second impeller gear 336 that is coupled to the second impeller 304 via a gear shaft 338.

In this manner, the first impeller 302 may be configured to rotate in a clockwise direction 340, which causes the second impeller 304 to rotate in a counterclockwise direction 342. The counter-rotating impellers 302 and 304 pull water in through the input port 306 disposed on the front portion 312 of the housing 316 and push water out of the nozzle 318, through an opening 344 disposed therein. A grate 346 (or other protective covering such as, for example, a screen) may be disposed over the input port 306 to prevent objects from entering the chamber 320 and causing damage to, and/or being damaged by, the impellers 302 and 304 and/or other parts within the housing 316.

Each of the impellers 302 and 304 may include a number of blades 308 configured such that as the impeller rotates, water is moved from the input port 306 toward the output nozzle 318, e.g., along the illustrative flow path generally indicated at 310. In embodiments, the impellers 302 and 304 (and blades 308) may be configured according to any number of impeller designs, including designs that are generally similar to the design of Pelton wheels, as shown in FIGS. 8-13. Additionally, in embodiments, the blades 308 may be configured to optimize propulsion in view of various factors such as, for example, vessel weight, vessel configuration, water depth, average water temperatures, cavitation thresholds, and/or the like.

FIGS. 14-19 depict another illustrative marine propulsion system 400 in accordance with embodiments of the disclosure. The marine propulsion system 400 includes generally similar features and components as those in the marine propulsion systems 100 and 200 depicted in FIGS. 2-7 and 8-13, respectively, with the exception of the design of the impellers 402, 404, 406, and 408, and the locations of the input ports 410 and 412. As shown in FIGS. 14-19, the system 400 may include two pairs of impellers 402, 404 and 406, 408. Each pair of impellers may include a first impeller 402, 406 that is a centrifugal impeller having blades 414 configured so as to move water from the bottom 416 of the system 400 to the rear 418 of the system 400, and a second impeller 404, 408 that may be designed to be similar to a Pelton wheel, having a shorter profile and blades 420 designed for moving water from the front 422 of the system 400 to the rear 418 of the system 400.

The impellers of each pair may be rotated at the same speed or at different speeds. In one embodiment, the first impeller 402, 406 of each pair may be driven at a greater speed than the second impeller 404, 408 of each pair. In this manner, the input drive to the first impellers 402, 406 may be different, or separated from, the input drive to the second impellers 404, 408, or a common input drive may be used which is geared in a different manner between the first and second impeller sets to drive same at different speeds.

For example, the marine propulsion system 400 may be, or include, the marine propulsion system 102 depicted in FIG. 1 and may be configured to be coupled to a vessel (e.g., the vessel 100 depicted in FIG. 1). As shown in FIGS. 14-19, the marine propulsion system 400 includes a housing 424 and an output nozzle 426 coupled to the rear portion 418 of the housing 424. The output nozzle 426 may be moveably (e.g., pivotably) coupled to the housing 424. In this manner, the output nozzle 426 may be used for steering and/or other positional control of a vessel to which it is attached. One or more winglets or other features may be disposed on the outside of the output nozzle 426 to further achieve hydrodynamic objectives.

Figure 14:
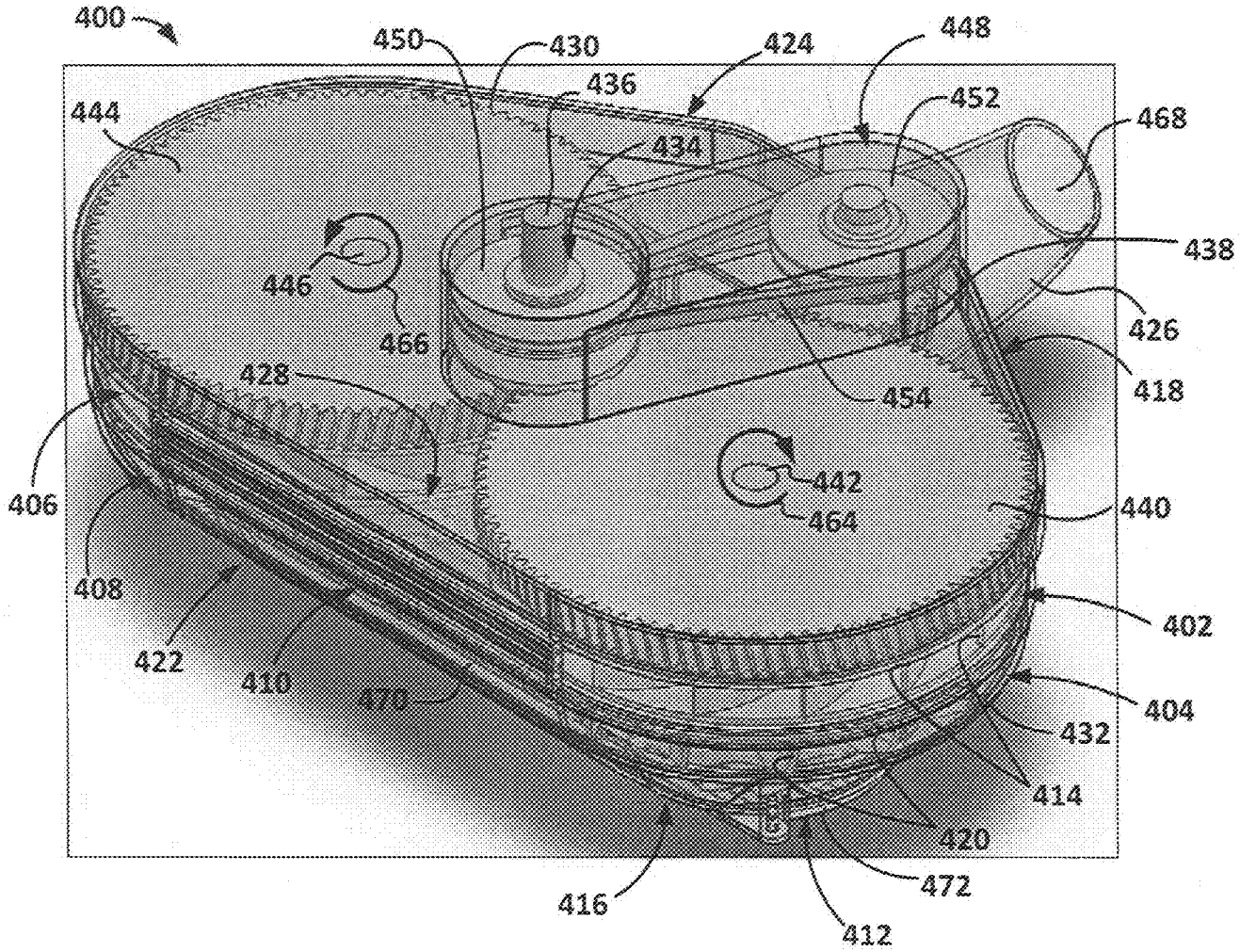
FIG. 14 is a partially-transparent upper perspective view of another marine propulsion system in accordance with an exemplary third embodiment of the present disclosure.
Figure 16:
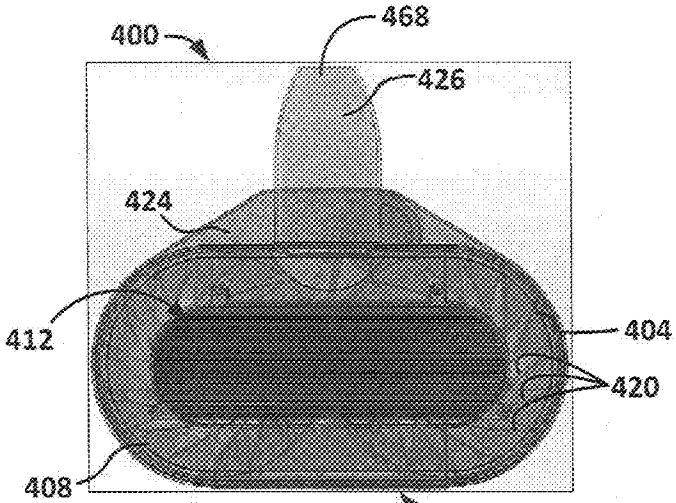
FIG. 16 is a partially-transparent bottom view of the marine propulsion system depicted in FIGS. 14 and 15.
Figure 15:
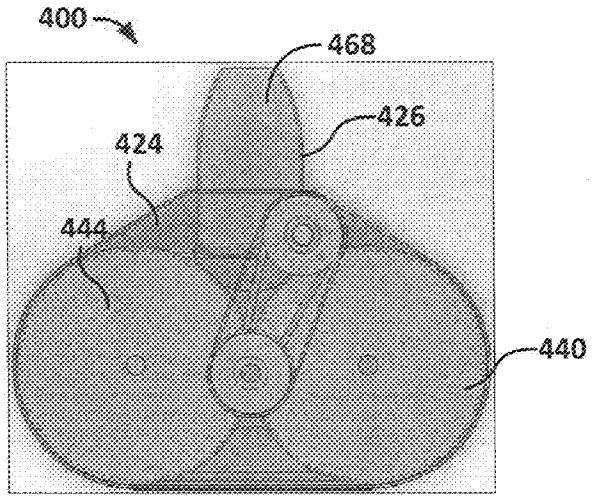
FIG. 15 is a partially-transparent top view of the marine propulsion system depicted in FIG. 14.
Figure 17:
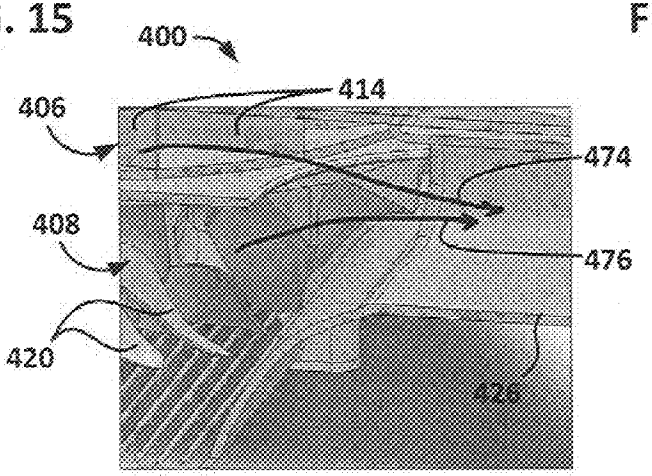
FIG. 17 is a perspective view of a portion of the marine propulsion system depicted in FIGS. 14-16.
Figure 18:
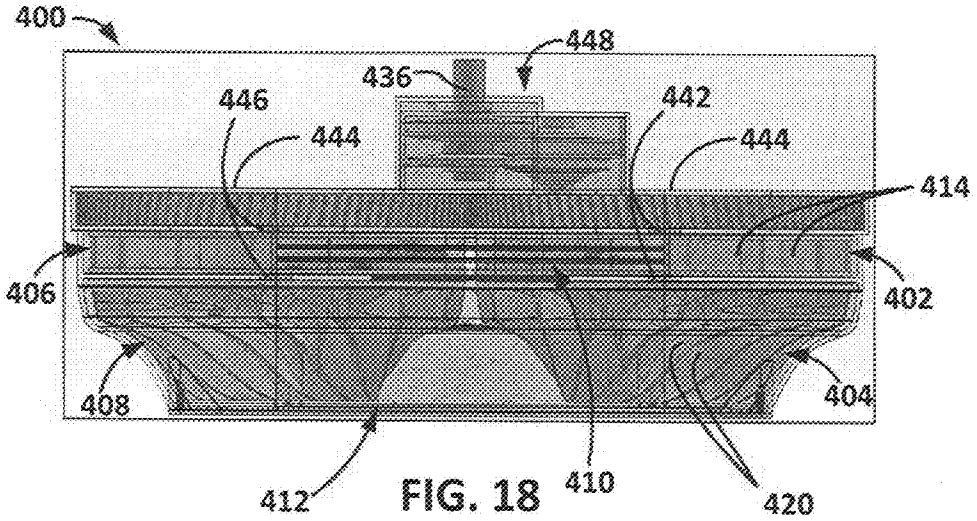
FIG. 18 is a partially-transparent front view of the marine propulsion system depicted in FIGS. 14-17.

The housing 424 may enclose a chamber 428, and generally includes an upper surface 430, a generally parallel and opposite-facing lower surface 432, the front portion 422, and the rear portion 418. The upper surface 430 may include attachment features (not shown) for coupling the housing 424 to a hull of a vessel, and attachment features may be included on other portions of the housing 424 such as, for example, for coupling the housing 424 within a portion of a hull. As shown in FIG. 14, the upper surface 430 of the housing 424 may include an aperture 434 through which a drive shaft 436 may pass. As shown in FIG. 14, the drive shaft 436 may be coupled to one or more drive gears 438, which may engage a first impeller gear 440 that is coupled to the first impeller 402 and (either directly or indirectly) the second impeller 404 via a gear shaft 442. The first impeller gear 440 may also be configured to engage a second impeller gear 444 that is coupled to the third impeller 406 and (either directly or indirectly) the fourth impeller 408 via a gear shaft 446. In embodiments, The system 400 may include a continuous variable transmission (CVT) 448, as illustrated in FIGS. 14-19. Additionally, the systems 200 and/or 300 may include a CVT similar to the CVT 448 depicted in FIGS. 14-19.

Figure 19:
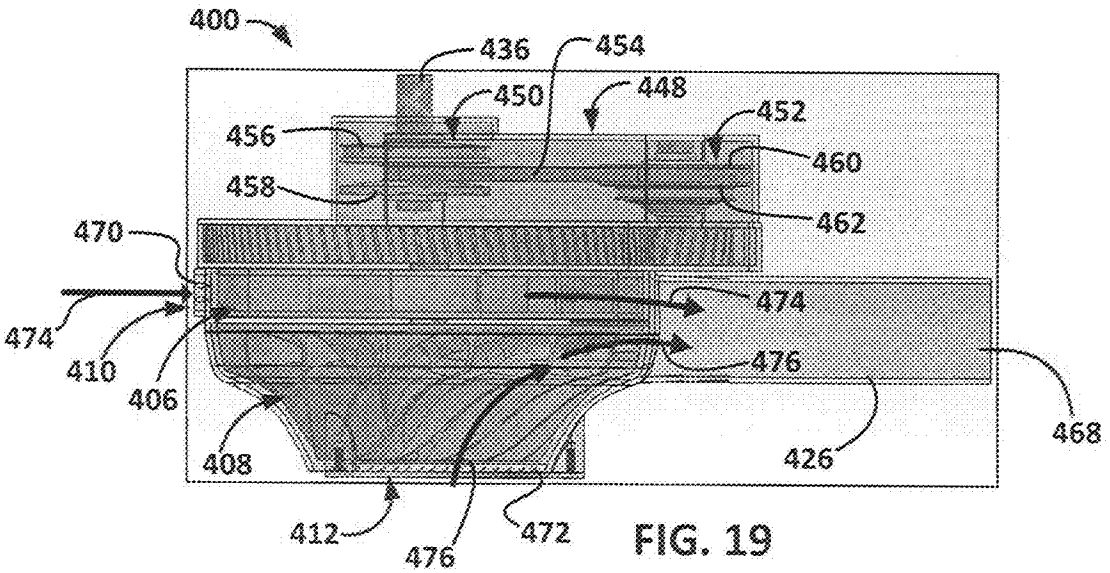
FIG. 19 is a partially-transparent side view of the marine propulsion system depicted in FIGS. 14-18.

As illustrated, the CVT 448 may include a drive pulley 450, coupled to the drive shaft 436, and a driven pulley 452 that engages the drive gear 438, with a v-belt 454 extending between the pulleys 450 and 452. The gear ratio may be changed, as with conventional CVT systems, by adjusting the effective diameters of the pulleys 452 and 454. That is, for example, as shown in FIG. 19, the drive pulley 450 may include a first sheave 456 and a second sheave 458, and the driven pulley 454 may include a first sheave 460 and a second sheave 462. The sheaves 456 and 458 of the drive pulley 450 can be moved closer together as the sheaves 460 and 462 are moved farther apart, and vice-versa, thereby changing the effective diameter of the pulleys 452 and 454 and, thus, the gear ratio.

In this manner, the first and second impellers 402 and 404 may be configured to rotate in a clockwise direction 464, which causes the third and fourth impellers 406 and 408 to rotate in a counterclockwise direction 466. The counter-rotating impellers 402, 404 and 406, 408 pull water in through the input ports 410 and 412 disposed on the front portion 422 and bottom portion 416 of the housing 424, respectively, and push water out of the nozzle 426, through an opening 468 disposed therein. A grate 470 (or other protective covering such as, for example, a screen) may be disposed over the input port 410 to prevent objects from entering the chamber 428 and causing damage to, and/or being damaged by, the impellers 402, 404, 406, and 408 and/or other parts within the housing 428. Similarly, a grate 472 (or other protective covering such as, for example, a screen) may be disposed over the input port 412.

Each of the impellers 402 and 406 may include a number of blades 414 configured such that as the impeller rotates, water is moved from the input port 410 toward the output nozzle 426, e.g., along the illustrative first flow path generally indicated at 474, which is substantially parallel to the surface of the water. In embodiments, the impellers 402 and 406 (and blades 414) may be configured according to any number of impeller designs, including designs that are generally similar to the design of Pelton wheels, as shown in FIGS. 14-19. Similarly, each of the impellers 404 and 408 may include a number of blades 420 configured such that as the impeller spins, water is moved from the input port 412 toward the output nozzle 426, e.g., along the second illustrative flow path generally indicated at 476, which curves from an input direction substantially perpendicular to the surface of the water proximate input port 412 upon entry into the impellers 404 and 408 to an output direction substantially parallel to the surface of the water upon exiting the impellers 404 and 408. Further, as may be seen in FIG. 19, first and second flow paths 474 and 476 merge with one another within output nozzle 426 at the exits from their respective impellers 402, 406 and 404, 408. The impellers 404 and 408 (and blades 420) may be configured according to any number of impeller designs, including centrifugal impeller designs, as shown in FIGS. 14-19. Additionally, the blades 414 and 420 may be configured to optimize propulsion in view of various factors such as, for example, vessel weight, vessel configuration, water depth, average water temperatures, cavitation thresholds, and/or the like.

In FIGS. 20-26, further embodiments are shown which, except for the differences discussed below, may include any of the features described above in connection with the foregoing embodiments.

Figure 20:
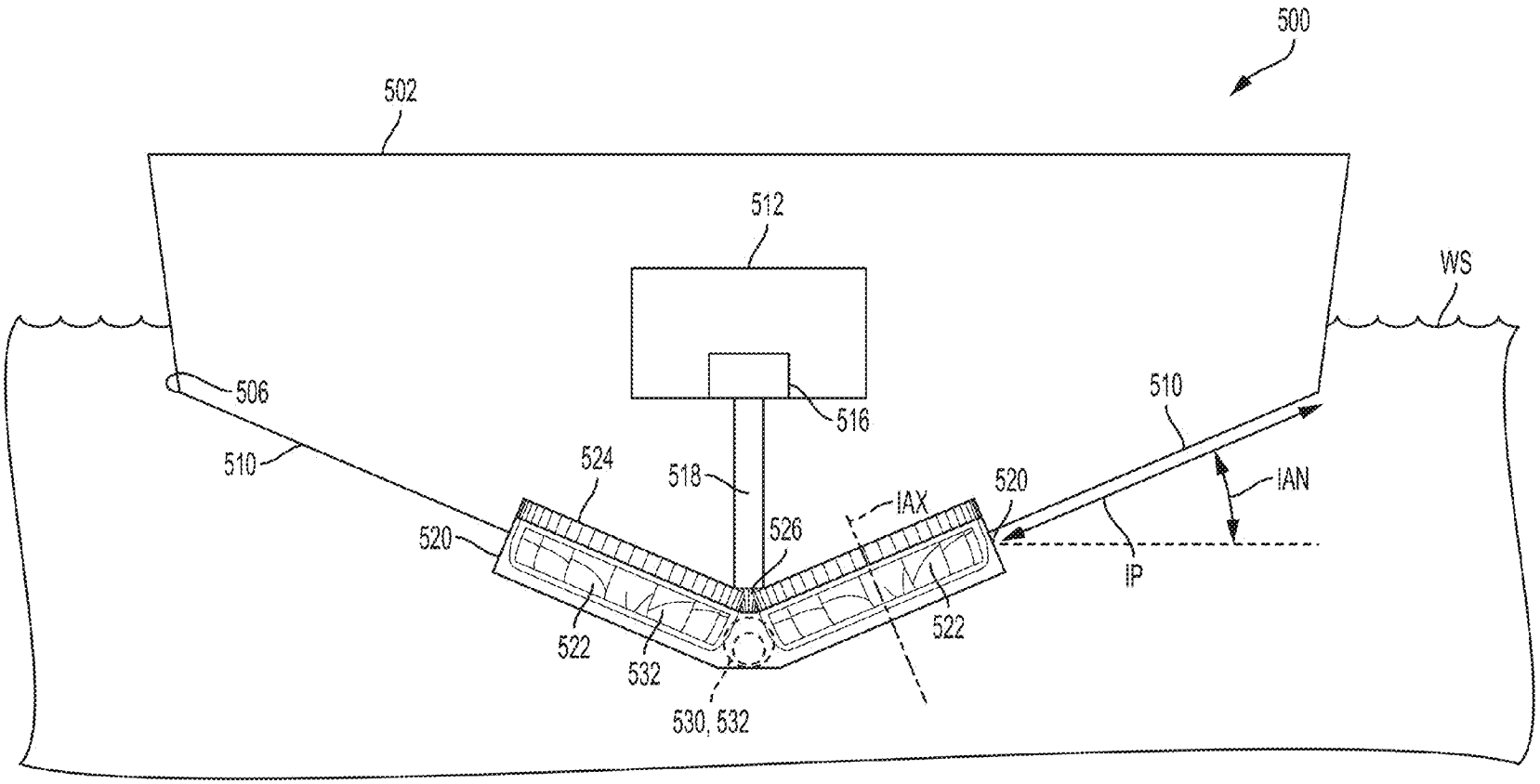
FIG. 20 is an end view of a marine vessel including a propulsion system in accordance with a further embodiment.
Figure 21:
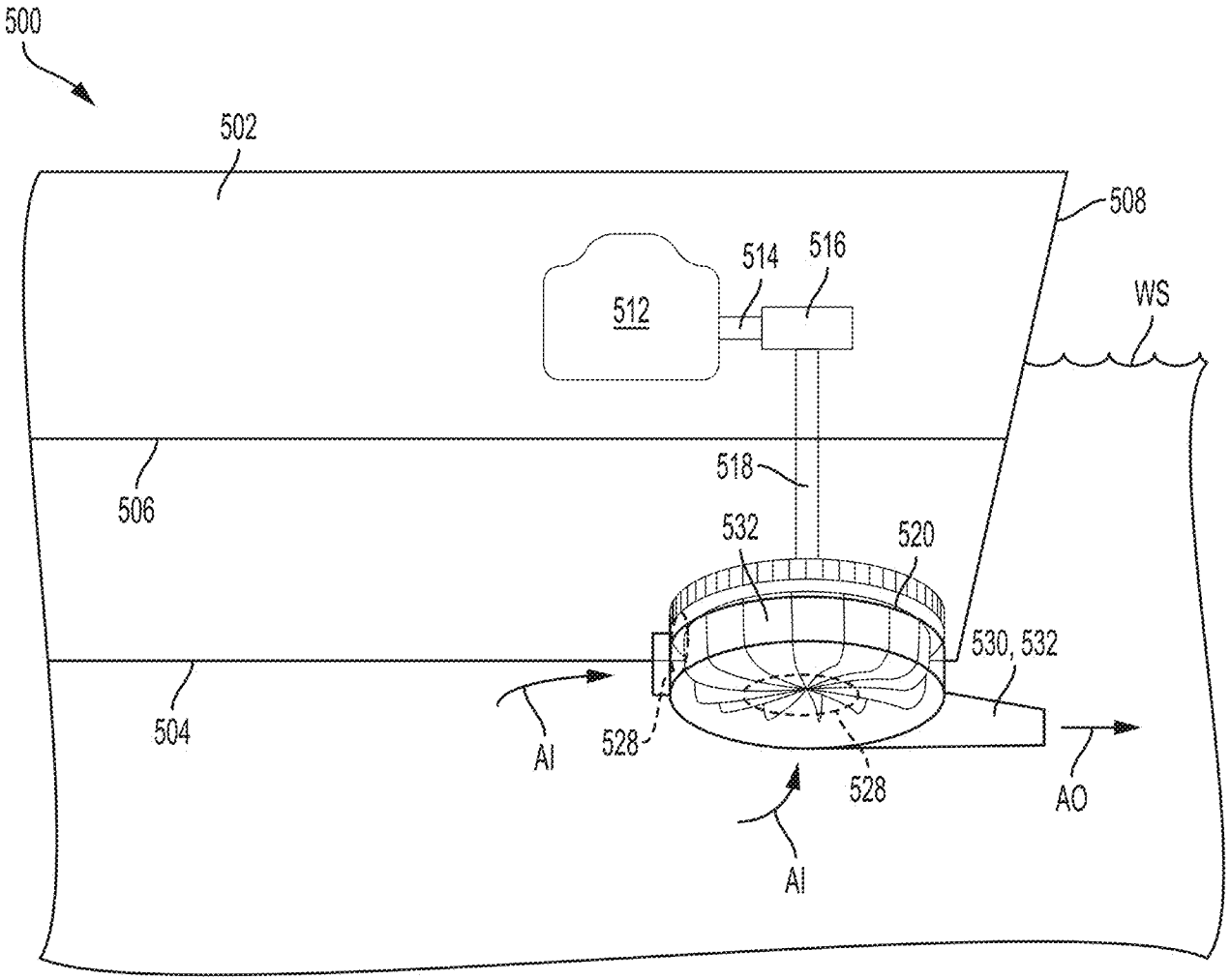
FIG. 21 is a side view of the marine vessel of FIG. 20.

Referring to FIGS. 20 and 21, a marine vessel 500 is shown, which includes a propulsion system according to a further embodiment. Marine vessel 500 generally includes a hull 502 having, as best shown in FIG. 21, a keel 504, chines 506, and transom 508. Hull 502 includes a pair of side walls or sides 510 generally extending between the bow and stern of vessel 500, with sides 510 joined at their lower ends at keel 504 and disposed at an angle with respect to one another, as discussed further below. In this manner, hull 502 may be configured as a V-hull in cross section, as shown in FIGS. 20-26, or alternatively, hull 502 may have other shapes, such as a rounded shape in cross-section, for example.

The marine propulsion system generally includes a drive source 512, such as an engine or motor which, in this embodiment, is carried within or above hull 502. An exemplary drivetrain between drive source 512 and the propulsion system includes an output shaft 514 drivingly coupled to drive source 512, transmission 516, and input shaft 518 drivingly coupled to the propulsion system. Transmission 516 drivingly couples input and output shafts may be a right angle drive, a geared drive or, as discussed above, a continuous variable transmission (CVT), for example. As shown in FIGS. 20 and 21, the components of the marine propulsion system, as described further below, are disposed near the stern of vessel 500, though such components may also be disposed near the bow of vessel 500 or in a central or amidships location of vessel 500.

The propulsion system also includes an impeller housing 520 mounted to, or integrated within, a lower portion of hull 502 near keel 504. Housing 520 includes a pair of counter-rotating impellers 522, which may also include associated impeller gears and drivetrain as described above in connection with prior embodiments.

However, as best shown in FIG. 20, as well as in the following embodiments, each impeller 522 rotates within a respective impeller plane IP which is disposed at an angle with respect to the water surface WS, and each impeller 522 rotates about an impeller axis IAX perpendicular to impeller plane IP and hull side 510 which is also disposed at an angle with respect to the water surface WS. The angle between impeller plane IP and the water surface WS is designated as angle IAN in FIG. 20, and may be as little as 1, 5, or 10 degrees, or as great as 20, 25, or 30 degrees, or may be within any range defined between any pair of the foregoing values, such as 1 to 30 degrees, 5 to 25 degrees, or 10 to 20 degrees, for example. In this manner, impeller plane IP in which each impeller 522 rotates is aligned substantially parallel to the respective hull side 510 with which the impeller 522 is associated. Alternatively stated, the impeller planes IP are aligned respectively with the "deadrise" angle of sides 510 of hull 502.

As with prior embodiments, impellers 522 may include impeller gears 524 in driving engagement with one another, with input shaft 518 in driving engagement with one or both of impeller gears 524, typically through a bevel gear drive 526, for example, though other drive arrangements are possible.

Impeller housing 520 includes one or more inlets 528 (FIG. 21) for water intake, which may be disposed at a front portion of housing 520 with respect to a direction of travel of marine vessel 500 and/or at lower portion of housing 520 facing away from the water surface WS. Housing 520 also includes one or more outlets 530 for water expulsion, which optionally may also include a nozzle 532 of the type described above, which may be fixed or may be movable to aid in steering and/or trim control of vessel 500.

Also similar to the prior embodiments, each impeller 522 may include a plurality of curved blades 532 as is typical with Pelton wheel or centrifugal impeller designs, and the number of curved blades may be as few as 2, 3, or 4, or as great as 6, 8, 10, or greater, for example. Each blade 532 may be curved either only in a single plane or may have a complex curvatures in multiple planes. In use, as shown in FIG. 21, impellers 522 are driven to convey water through one or more inlets 528 along the direction of one or more of arrows AI and then to blend the flow of water from each impeller 522 at outlet 530 to thereby push water from inlet 528 and through outlet 530 along the direction of arrows AO to impart thrust to drive to marine vessel 500.

Advantageously, with impellers 522 disposed, and rotatable within, impeller planes IP which are substantially parallel to their respective sides 510 of hull 502, the profile of housing 520 may be reduced in a manner in which housing 520 substantially conforms to the shape of hull 502 to facilitate minimum frictional drag of housing 520 in the water when vessel 500 is propelled. Housing 520 and its inlet(s) 528 and outlet(s) 520 may also be integrated into hull 502 in a manner in which the overall shape of hull 502 is substantially smooth and uninterrupted.

Figure 22:
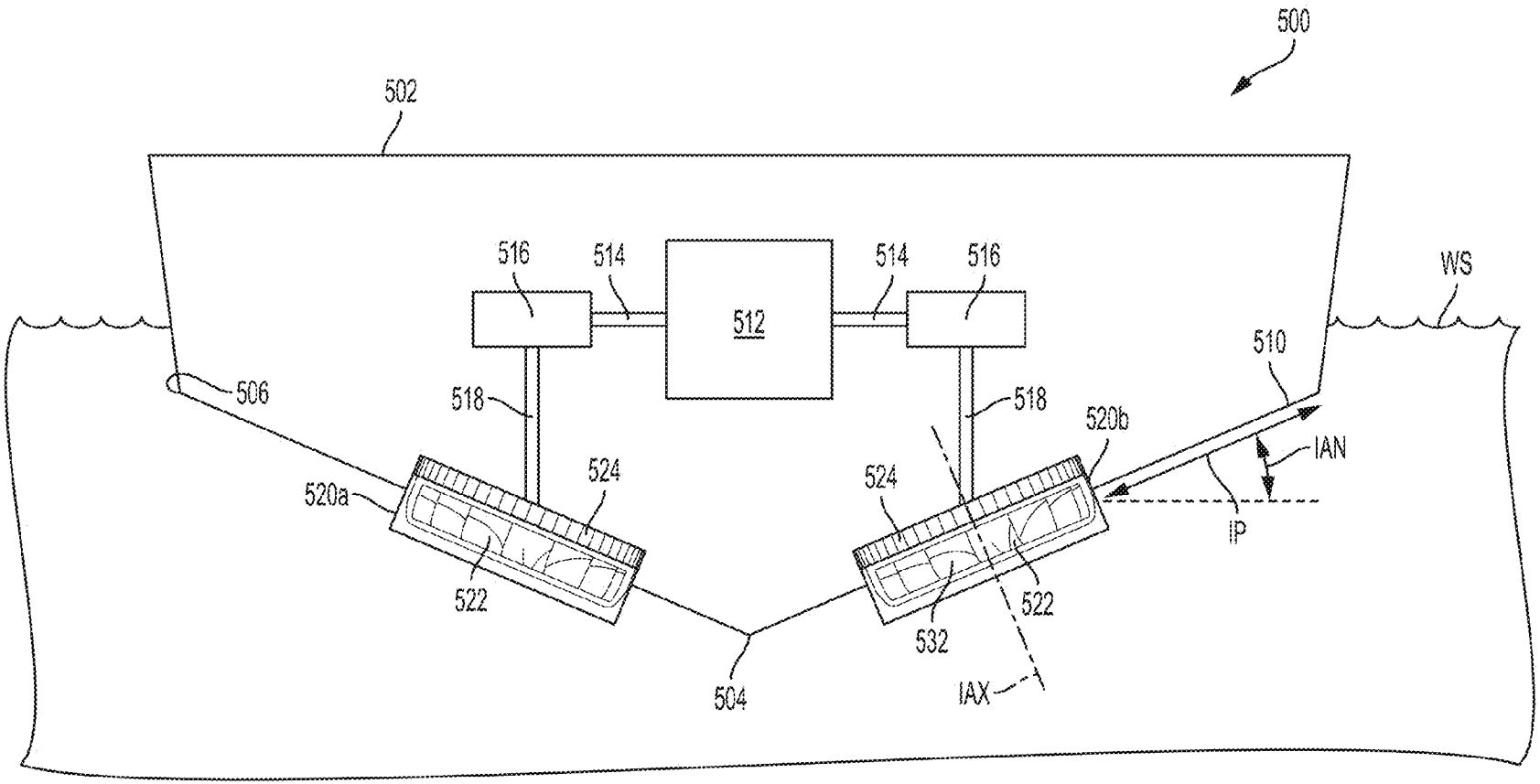
FIG. 22 is an end view of a marine vessel including a propulsion system in accordance with a further embodiment.
Figure 23:
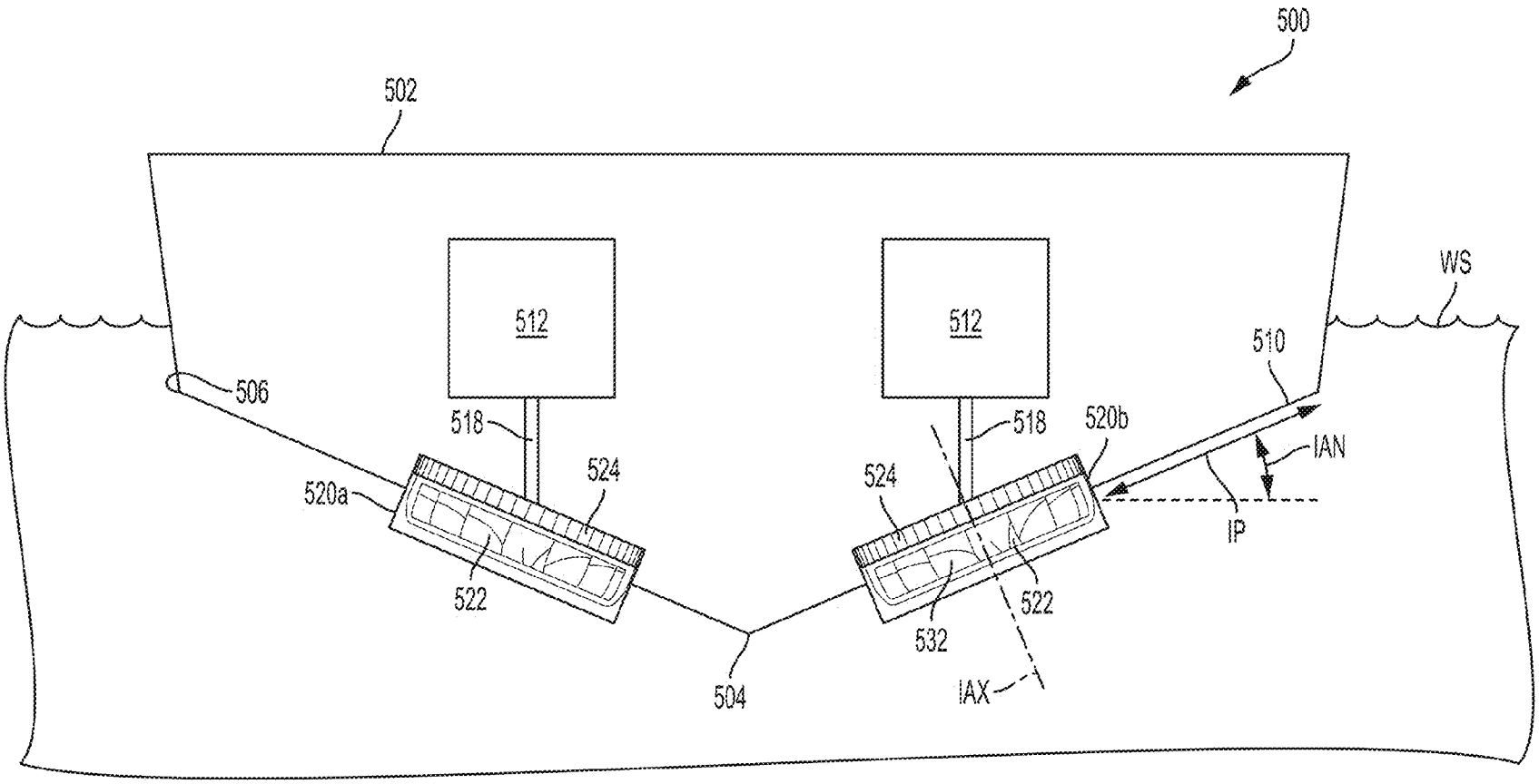
FIG. 23 is an end view of a marine vessel including a propulsion system in accordance with a further embodiment.

Referring to FIGS. 22 and 23, further embodiments are shown which, except as described below, are similar to the prior embodiments, and the same reference numerals have been used to designate similar or substantially similar features. In this embodiment, impellers 522 may be separate from one another and disposed in separate, spaced-apart housings 520*a* and 520*b* which are attached to, or integrated within, their respective sides 510 of hull 502. In this manner, each housing 520*a* and 520*b* and its associated impeller 522 may also be spaced in a direction away from the keel 504 toward the water surface WS. Further, in this embodiment, impellers 522 are driven by separate drive shafts 518, either via a common drive source 522 as in the embodiment of FIG. 22, or via separate drive sources 512 as in the embodiment of FIG. 23, and each may or may not include associated transmissions 516. In this embodiment, impellers 522 may be counter-rotating or alternatively, may rotate in the same direction. One advantage of this embodiment is that housings 520*a* and 520*b*, whether attached to, or integrated into, hull 502, may have a reduced profile to minimize frictional drag of hull 502 within the water, with keel 504 remaining exposed or uninterrupted from the bow to the stern of vessel 500 to maintain proper tracking of vessel 500 through the water.

Further, in connection with the above embodiments, vessel 500 may have multiple propulsion systems associated with hull 502, including multiple impellers 522 disposed in spaced relation along sides 510 of hull 502 from the bow to the stern of vessel 500 and/or multiple impellers 522 spaced between keel 504 and the upper ends of sides 510, each impeller 522 having a common drive source 512 or the impellers 522 having individual, dedicated drive sources 512.

Figure 24:
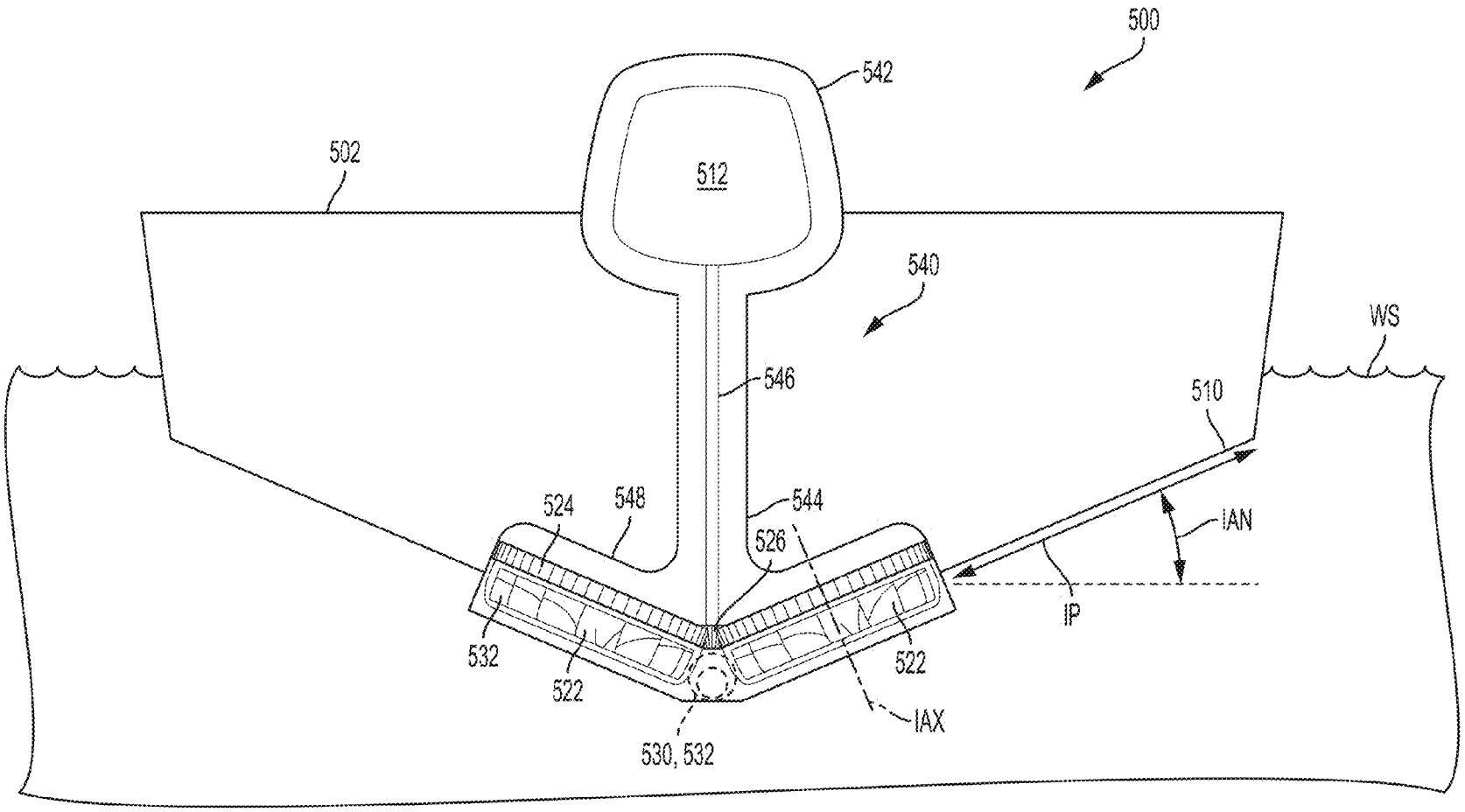
FIG. 24 is an end view of a marine vessel including a propulsion system in accordance with a still further embodiment.
Figure 25:
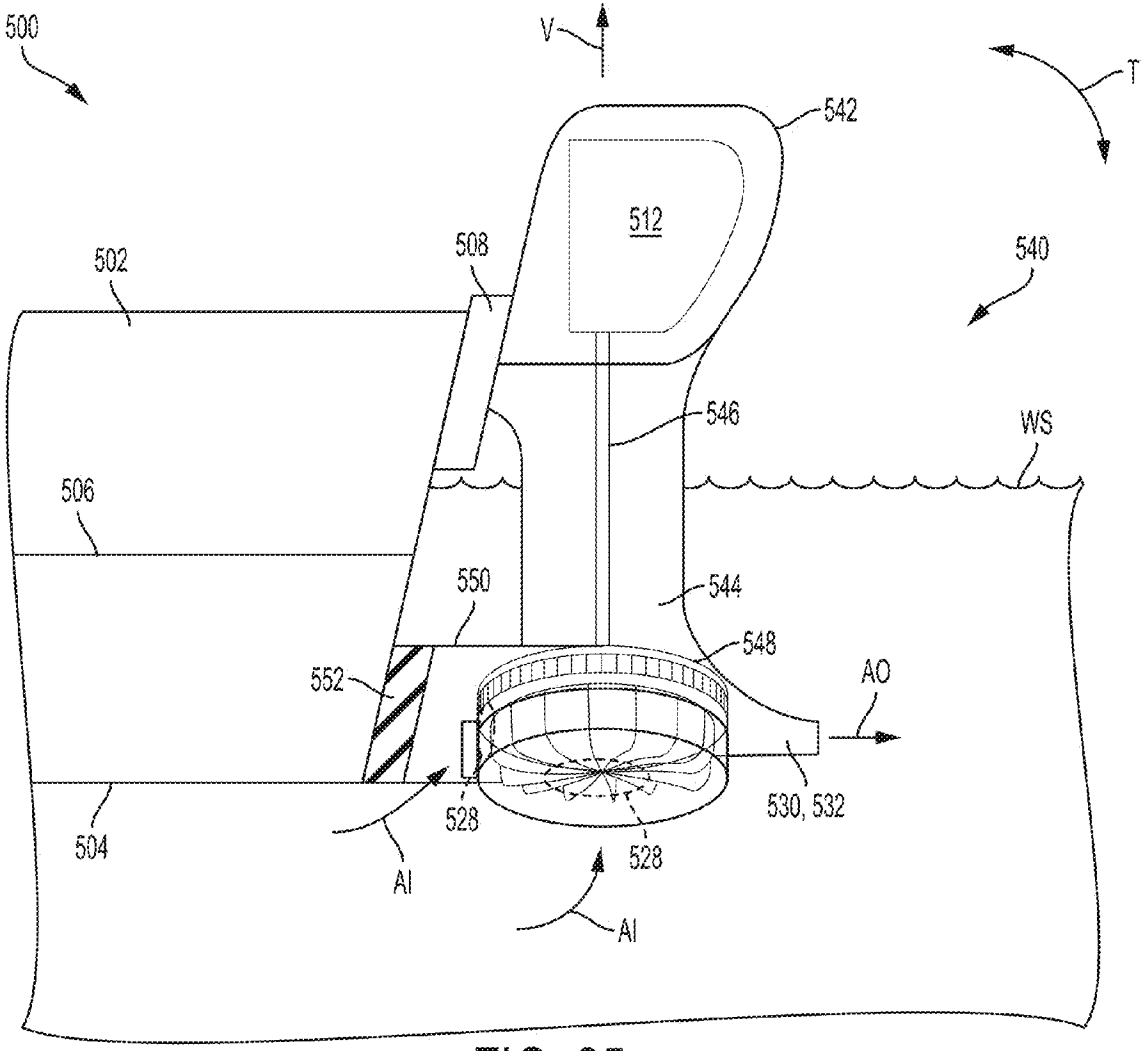
FIG. 25 is a side view of the marine vessel of FIGS. 24 and 26.
Figure 26:
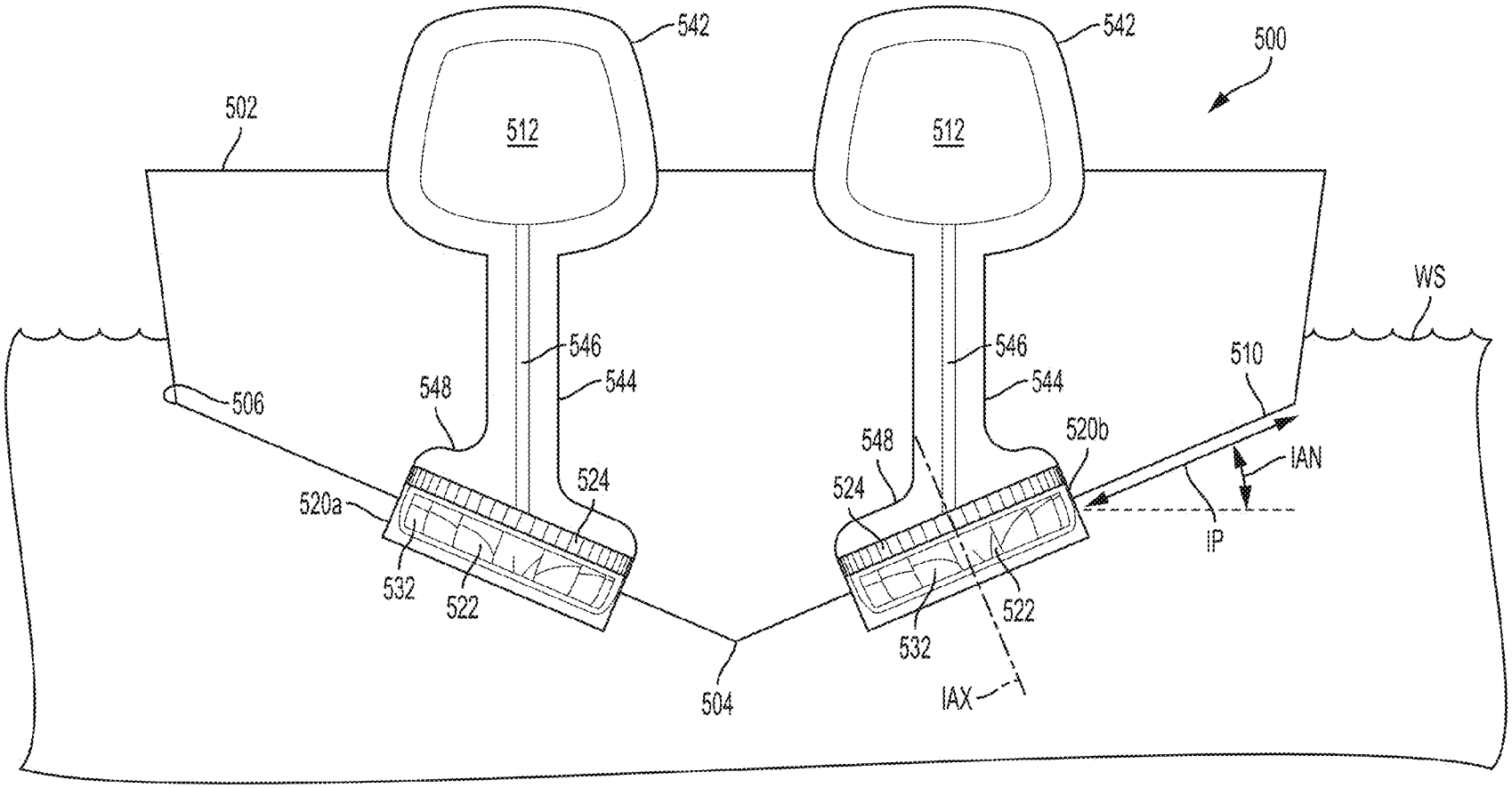
FIG. 26 is an end view of a marine vessel including a propulsion system in accordance with a still further embodiment.

In FIGS. 24-26, further embodiments are shown which, except as described below, are similar to the prior embodiments, and the same reference numerals have been used to designate similar or substantially similar features. Vessel 500 includes at least one outboard or stern drive unit 540 mounted to transom 508 of hull 502, as best shown in FIG. 25. Outboard unit 540 includes a powerhead section 542 with a drive source 512, such as an engine or motor, and a lower unit 544 including drive shaft 546 and/or gearing, as well as an impeller housing 548 including a pair of impellers 522 as described above. Outboard unit 540 is mounted to transom 508 in a manner in which outboard unit 540 may include a tilt function along arrow T in FIG. 24 for vessel trim control and/or trailing, as well as vessel steering control by pivoting outboard unit 540 about a substantially vertical axis V.

As best shown in FIG. 23, lower unit 544 includes impeller housing 548 containing a pair of impellers 522 in which impellers 522 are counter-rotating and commonly driven as described above in prior embodiments, with housing 548 also including one or more inlets 528 and one or more outlets 530 as described above, with outlet 530 optionally including nozzle 532.

In an additional feature of this embodiment best shown in FIG. 25, lower unit 544 may incorporate a housing extension portion 550 which, when outboard unit 540 is disposed toward a maximum downward tilt position, directly abuts transom 508 to eliminate any fluid gap between hull 502 and lower unit 544. The extension portion 550 may include a bumper 552 of compressible material such as natural or synthetic rubber or a compressible plastic, for example, to form a compressive seal against transom 508. In this manner, when extension portion 550 of impeller housing 548 engages transom 508, lower unit 544 effectively becomes a continuous extension of hull 502 to aid vessel 500 in coming up on plane in the water when vessel 500 is accelerated from a stopped position or from idle speed.

In FIG. 26, a further embodiment is shown in which two outboard units 542 are mounted to transom 508 in spaced relation with respect to one another, with one including a housing 520*a* associated or aligned with one hull side 510 and the other including housing 520*b* associated or aligned with the other hull side 510, each housing 520*a* and 520*b* including at least one inlet and at least one outlet. In this manner, impeller plane IP in which each impeller 522 rotates is aligned substantially parallel to a respective hull side 510 with which the impeller 522 is associated. Alternatively stated, the impeller planes IP are aligned respectively with the "deadrise" angle of sides 510 of hull 502.

While embodiments of the present disclosure are described with specificity, the description itself is not intended to limit the scope of this patent. Thus, the inventors have contemplated that the claimed disclosure might also be embodied in other ways, to include different steps or features, or combinations of steps or features similar to the ones described in this document, in conjunction with other technologies.

The invention claimed is:

1. A marine vessel, comprising:

a hull having a pair of opposite sides disposed at an angle with respect to one another and with respect to a water surface; and a marine propulsion system operatively coupled to the hull and including a pair of impellers respectively associated with the pair of hull sides that rotate within respective impeller planes disposed generally parallel to the hull sides to convey water from at least one inlet through at least one outlet to provide thrust to the vessel; and at least one drive source drivingly coupled to the impellers, wherein the impellers rotate in opposite directions.

2. The marine vessel of claim 1, wherein the marine propulsion system further comprises a housing in which the impellers are disposed, the housing operatively coupled to the hull and including the inlet and the outlet.

3. The marine vessel of claim 2, wherein the outlet further comprises an output nozzle, the output nozzle having an opening out of which water is pushed by the impellers to provide the thrust, wherein the output nozzle is moveable, thereby facilitating steering control and/or vessel trim control.

4. The marine vessel of claim 1, wherein the hull is V-shaped in cross section and the impeller planes are disposed at an angle between 1 and 30 degrees with respect to the water surface.

5. The marine vessel of claim 1, wherein the marine propulsion system further comprises a pair of housings in which the impellers are respectively disposed, the housings spaced from one another and operatively coupled to the hull and each including a respective inlet and outlet.

6. A marine vessel, comprising:

a hull having a pair of opposite sides disposed at an angle with respect to one another and with respect to a water surface; and a marine propulsion system operatively coupled to the hull and including a pair of impellers respectively associated with the pair of hull sides that rotate within respective impeller planes disposed generally parallel to the hull sides to convey water from at least one inlet through at least one outlet to provide thrust to the vessel; and at least one drive source drivingly coupled to the impellers, wherein the marine propulsion system is disposed within an outboard unit connected a transom of the hull.

7. The marine vessel of claim 6, wherein the outlet further comprises an output nozzle, the output nozzle having an opening out of which water is pushed by the impellers to provide the thrust.

8. The marine vessel of claim 7, wherein the outboard unit includes a lower unit with an extension portion engageable with the transom of the vessel to form a continuous extension portion of the hull.

9. The marine vessel of claim 1, wherein each of the impellers includes at least three curved blades.

10. A marine vessel, comprising:

a hull having a pair of opposite sides disposed at an angle with respect to one another and with respect to a water surface; and a marine propulsion system operatively coupled to the hull and including a pair of impellers respectively associated with the pair of hull sides that rotate within respective impeller planes disposed generally parallel to the hull sides to convey water from at least one inlet through at least one outlet to provide thrust to the vessel;

at least one drive source drivingly coupled to the impellers; and a transmission system coupled to the impellers via a drive shaft, wherein the transmission system is configured to enable an operator to change the speed of the impellers in relation to the speed of the input shaft.

11. The marine vessel of claim 1, wherein the marine propulsion system is integrated into the hull.

12. A marine vessel, comprising:

a hull having a transom and a pair of sides disposed at an angle with respect to one another and with respect to a water surface; and at least one outboard unit attached to the transom and including a marine propulsion system comprising:

at least one drive source;

a housing including at least one inlet and at least one outlet; and an impeller disposed within the housing that rotates within an impeller plane disposed generally parallel to one of the sides of the hull and at an angle with respect to a water surface to convey water from the inlet though the outlet to provide thrust to the vessel.

13. The marine vessel of claim 12, wherein the housing includes a pair of impellers that rotate within respective impeller planes disposed generally parallel to respective sides of the hull and at an angle with respect to a water surface to convey water from the at least one inlet though the at least one outlet to provide thrust to the vessel.

14. The marine vessel of claim 13, wherein the impeller planes are disposed at an angle between 1 and 30 degrees with respect to the water surface.

15. The marine vessel of claim 12, wherein the at least one outlet further comprises an output nozzle, the output nozzle having an opening out of which water is pushed by the impellers to provide the thrust.

16. The marine vessel of claim 12, wherein the outboard unit includes a lower unit with an extension portion engageable with the transom of the vessel to form a continuous extension portion of the hull.

17. The marine vessel of claim 12, wherein each of the impellers includes at least three curved blades.

18. The marine vessel of claim 12, further comprising a pair of outboard units, each unit including at least one drive source, a housing including at least one inlet and at least one outlet; and an impeller disposed within the housing that rotates within an impeller plane disposed generally parallel to one of the hull sides and at an angle with respect to a water surface to convey water from the inlet though the outlet to provide thrust to the vessel.

19. The marine vessel of claim 18, wherein the impeller planes are disposed at an angle between 1 and 30 degrees with respect to the water surface.

20. The marine vessel of claim 1, wherein the at least one inlet includes a forward inlet facing in a horizontal direction toward a front end of the hull and a lower inlet facing in a vertical direction away from a respective side of the hull.

21. The marine vessel of claim 6, wherein the at least one inlet includes a forward inlet facing in a horizontal direction toward a front end of the hull and a lower inlet facing in a vertical direction away from a respective side of the hull.

22. The marine vessel of claim 10, wherein the at least one inlet includes a forward inlet facing in a horizontal direction toward a front end of the hull and a lower inlet facing in a vertical direction away from a respective side of the hull.

23. The marine vessel of claim 12, wherein the at least one inlet includes a forward inlet facing in a horizontal direction toward a front end of the hull and a lower inlet facing in a vertical direction away from a respective side of the hull.

* * * * *